United States Patent [19]

Bonhard

[11] Patent Number: 4,557,430

[45] Date of Patent: Dec. 10, 1985

[54] POWER CORD STORAGE AND DISPENSER

[76] Inventor: Robert B. Bonhard, 23230 Tireman Ave., Dearborn Heights, Mich. 48127

[21] Appl. No.: 632,226

[22] Filed: Jul. 19, 1984

[51] Int. Cl.[4] ..... B65H 75/40

[52] U.S. Cl. ..... 242/96; 191/12.2 R

[58] Field of Search ..... 242/96, 86, 107.14, 242/107.15, 99; 191/12.2 R, 12.4

[56] References Cited

U.S. PATENT DOCUMENTS

| | | | |
|---|---|---|---|
| 1,920,843 | 8/1933 | Counihan | 191/12.2 R X |
| 1,952,480 | 3/1934 | Thompson | 191/12.2 R X |
| 2,393,613 | 1/1946 | Combs | 242/96 |
| 2,801,303 | 7/1957 | Pailing | 191/12.4 |
| 4,061,290 | 12/1977 | Harrill | 242/96 |
| 4,244,536 | 1/1981 | Harrill | 242/96 |
| 4,330,005 | 5/1982 | Kjarsgaard | 242/96 X |
| 4,338,497 | 7/1982 | Drew | 191/12.4 |
| 4,429,839 | 2/1984 | Jessamine | 242/96 |
| 4,467,979 | 8/1984 | Koehler | 191/12.4 X |

*Primary Examiner*—John M. Jillions

*Attorney, Agent, or Firm*—Barnes, Kisselle, Raisch, Choate, Whittemore & Hulbert

[57] ABSTRACT

A wind-up reel for cooling and storage of heavy duty utility electric cord which includes three elements in the form of a housing open at one side, a rotating facer plate to close that opening and an idle plate to form a spool with the face plate and rotatable with the coil and face plate to protect the coil against abrasion and to provide a lateral bearing surface against the outer case. A storage recess in the face plate will house one functional end of the cord. Spaced reinforcing on the housing and the facer plate provides a structure which can be light in weight while maintaining the proper shape for the function.

3 Claims, 8 Drawing Figures

POWER CORD STORAGE AND DISPENSER

FIELD OF INVENTION

Portable storage units for coiled electric power cords for use in boats or utility trucks with convenient payout for remote power sources.

BACKGROUND OF INVENTION

Building contractors, utility workers and boaters frequently have a need for a power cord to bring electric energy from a remote female receptacle to an area where the energy is to be used. Boaters, for example, often tie up at a harbor where the electric receptacles are quite some distance from the boat. Similarly, both inside and outside building contractors have need for an electric source for power saws, drills and the like when working on new houses where power has not yet been installed.

Thus, there is a need for a portable power cord which can be neatly coiled and confined in a portable carrying case. The power cord must be readily dispensable in a relatively free pay-out and the cord must be readily retrievable by winding it into a spool in the case.

Devices of the general type above described are illustrated in U.S. Pat. Nos. 4,138,177 (van Valer, 1979) and 4,282,954 (Hill, 1981).

It is an object of the present invention to provide a power cord storage unit which has significant advantages over those previously known in the art. Cost, weight, and durability are important factors in the design, manufacture and use of the cord storage units. The present invention contemplates a device which is light in weight and yet sturdy enough to withstand the use and abuse that it may receive. A further object is an inner reel which, in conjunction with the housing, prevents abrasion of the cord when being wound or unwound. A further object is a cable reel design with a recess for the male plug which is within the confines of the housing to prevent damage to the plug and eliminate projections which would interfere with storage. A recessed handle also is available for the retraction of the cord for storage. This device utilizes the existing female end of the cord and allows the user to actually remove the entire cord if desired.

Other objects and features of the invention will be apparent in the following description and claims in which the invention is described together with details to enable persons skilled in the art to practice the invention all in connection with the best mode presently contemplated for the invention.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

Figure 1:
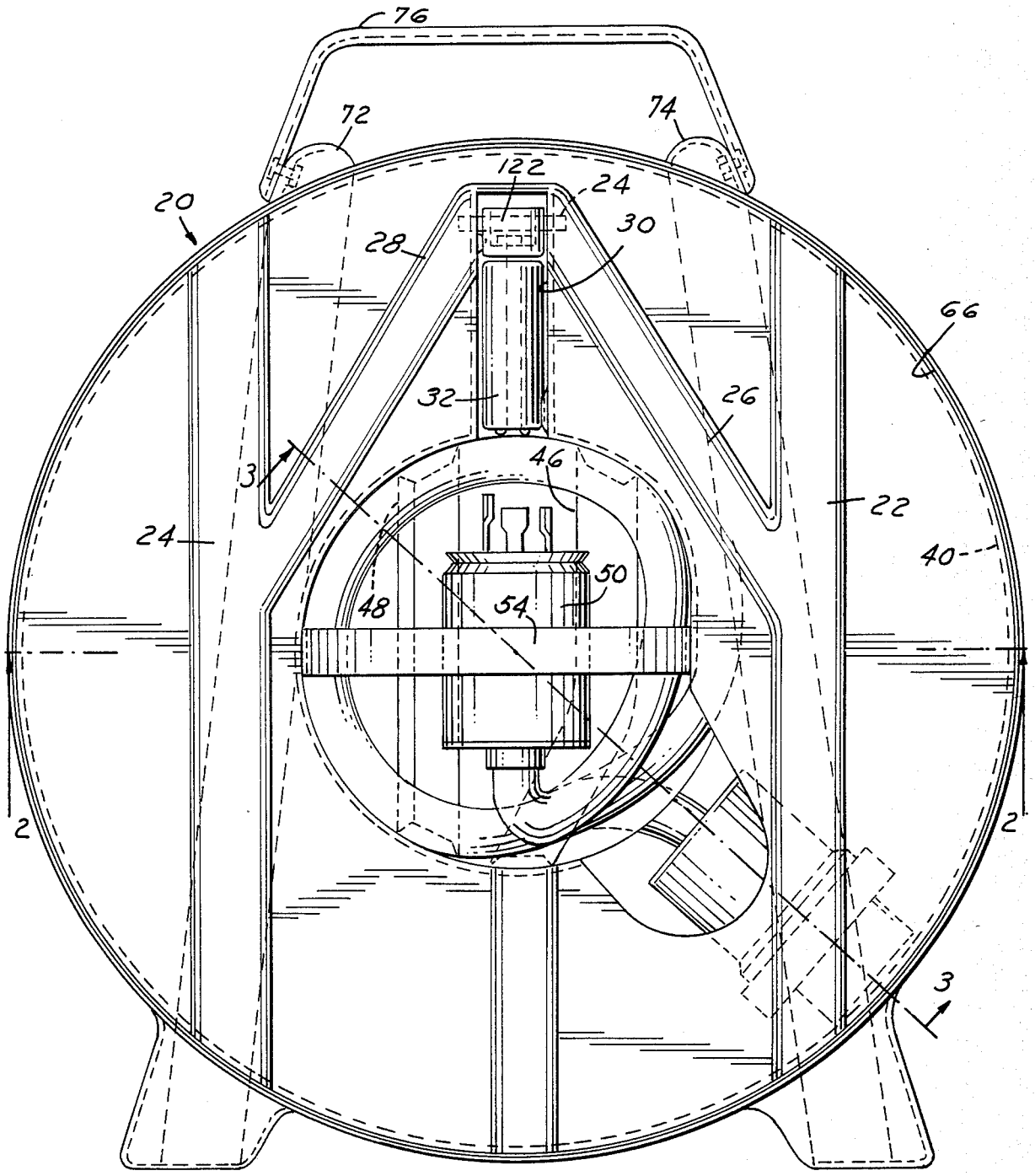
FIG. 1, a side elevation of the storage unit as assembled.

In FIG. 1, a side elevation of the storage unit is shown illustrating a front housing face plate 20 formed of a molded high density polyethylene low-friction plastic material which has some flexibility but which is highly resistant to impact and shock. In order that the material of the housing element may be as thin as is practicable, reinforcing ribs 22 and 24 are shown extending from the top to the bottom of the housing face plate and shorter diverging ribs 26 and 28 interconnect to the main ribs. These ribs stiffen the face plate to provide planar stability.

Figure 8:
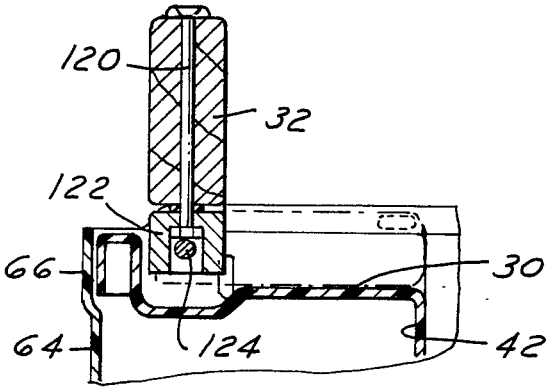
FIG. 8, a sectional view of the winding handle and mount in operative position.

A radially disposed recess 30 symmetrically between ribs 26, 28 is provided for a swing-out handle 32 shown in detail in FIG. 8. The main plate forming the face of element 20 has an inwardly extending outer rim flange 40, FIG. 2, and an inwardly extending dished portion centrally of the plate with an axially extending side wall 42 closed by a central plate 44 forming the closing wall of the dished portion and serving as a portion of the winding hub of the composite reel.

Figure 5:
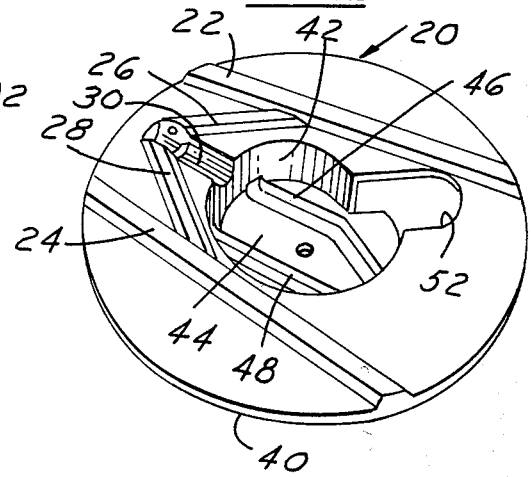
FIG. 5, a perspective view of the outer face of one element of the winding reel.

As shown best in FIG. 5, stiffening ribs 46 and 48 reinforce the closing wall 44 and contribute to the planar stability. The interior of the dished portion facing the outside of the assembled unit provides a recess 45 for a male plug 50 of an electric cord to be housed in the unit. A radial recess 52 in the wall 42 and plate 20 provides cord space if needed. Thus, the plug can be stored within the confines of the overall unit. There is a pivoting U-shaped retaining bar 54 that holds coil plug 50 in recess 45. See FIGS. 1 and 2.

Figure 2:
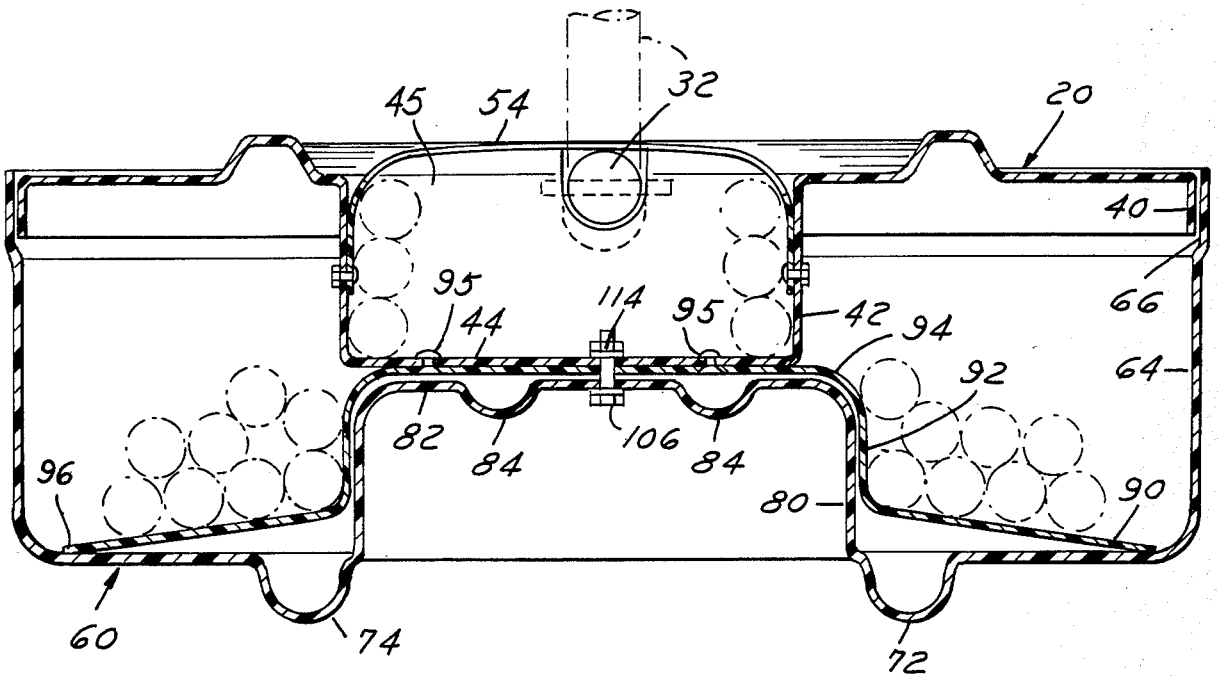
FIG. 2, a sectional view on line 2—2 of FIG. 1.
Figure 3:
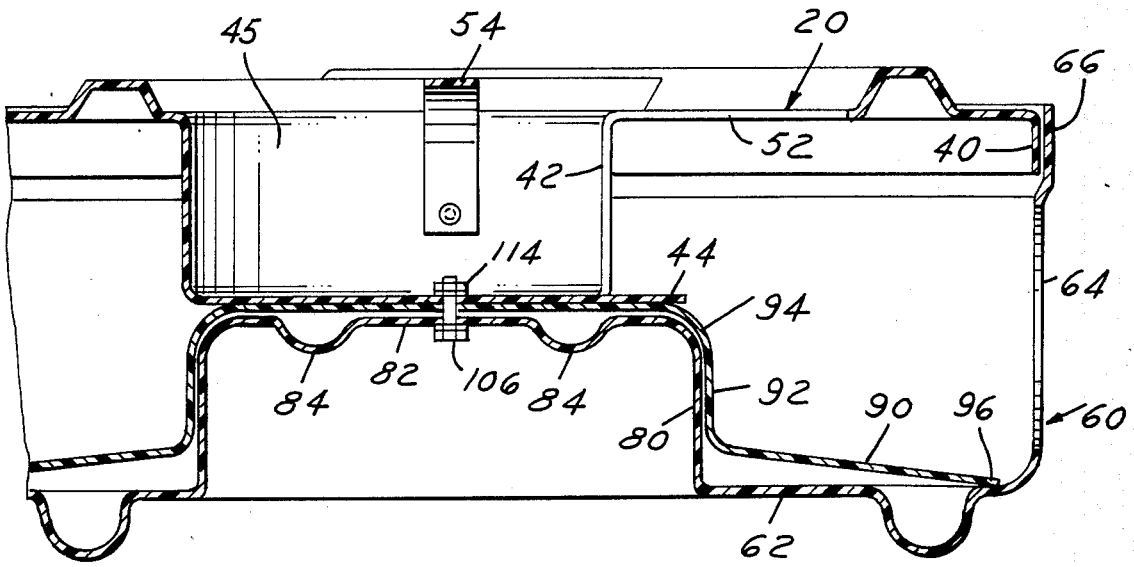
FIG. 3, a sectional view on line 3—3 of FIG. 1.
Figure 6:
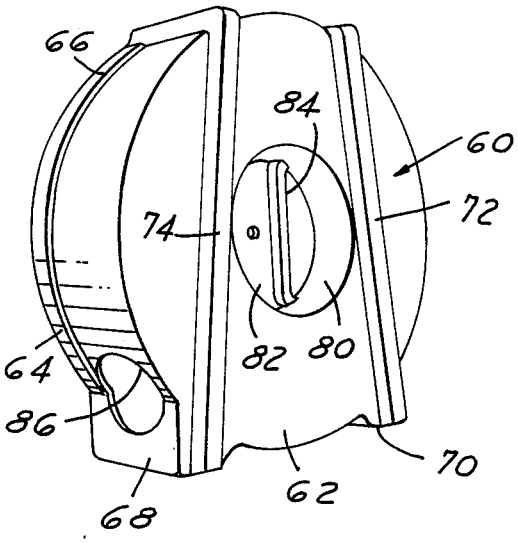
FIG. 6, a perspective view of the rear side of a case element of the unit.

The second and basic element of the assembly is a circular housing 60 illustrated as a perspective rear elevation in FIG. 6 and in cross-section in FIGS. 2 and 3. This housing or case 60 has a relatively flat rear wall 62 and a side enclosing wall 64 which enlarges at the open side to a narrow flange 66. This offset flange 66 reinforces the wall 64 of the case 60 and assists in maintaining the roundness of the open edge of the case or housing 60. Two spaced supporting foot portions 68 and 70 are molded with this one-piece housing to extend beyond the circumference of the housing to provide stable support for the assembly. Two diverging reinforcing ribs 72 and 74 are molded integrally with the housing 60 and these extend over the top to provide fastening surfaces for a handle 76 (FIG. 1). These ribs 72, 74 contribute also to the maintaining of the roundness of the case 60.

The rear wall 62 of housing case 60 is also dished inwardly to provide an axially extending wall 80 with a closing wall 82, the latter wall being reinforced with ribs 84. This dished portion has a slightly smaller diameter than the dished portion in the front element 20 for reasons to be described below. The side wall 64 of the housing unit 60 has a bottom port hole 86 from which an electric cable line will extend in the use of the device.

Figure 4:
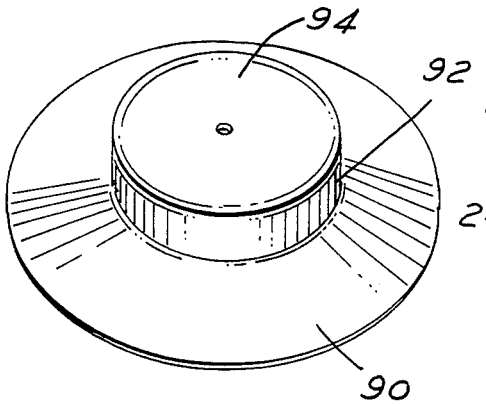
FIG. 4, a perspective view of one element of the winding reel.

A third element in the assembly is a circular disc or brim 90 illustrated in a perspective view in FIG. 4. This disc 90 flares downwardly as shown in FIGS. 2 and 3 and also has a dished portion formed of a circular wall 92 and a closing wall 94. The disc has a diameter just slightly smaller than the inner diameter of the housing 60. The diameter of the wall 92 is slightly larger than the wall 80 of housing 60 and essentially the same as wall 42 in face plate 20.

The basic three elements are all preferably formed from the plastic previously referenced, namely, a polyethylene low-friction material with high impact resistance.

In FIG. 2, the three elements of the combination are shown in an assembled relationship in cross-section. The flange 40 of the front face plate 20 fits within the offset portion 66 of the rear housing 60 and closes the open side of that housing. Sufficient clearance is provided so the flange 40 will rotate freely within the offset 66. The third element 90 fits over the dished portion 80–82 of the rear housing with sufficient clearance that it may rotate relative to the housing 60. The rim 96 of the brim 90 is in contact with the inner face of housing 60 in a bearing relationship with a low friction contact resulting from the materials utilized. The closing wall 44 of element 20 and the closing wall 94 of element 90 are riveted together by rivets 95 which are countersunk to avoid contact with the closing wall 82 of element 60. Thus, these elements 20 and 90 rotate together.

Figure 7:
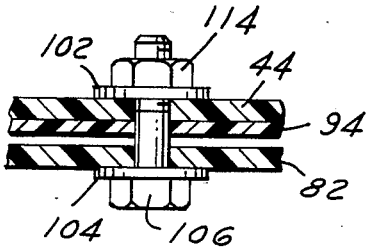
FIG. 7, an enlarged sectional view of the pivot mount for the reel.

In FIG. 7, an enlarged sectional view shows the manner in which the elements are fastened for relative rotation. A headed bolt 106 carries washers 102 and 104 and has a nut 114. This bolt transfixes the center portion of parts 82, 94 and 44 between the washers.

In FIG. 8, the handle 32 is rotatably mounted on a rod 120 secured to a block 122 pivoted on shaft 124 mounted between the walls of recess 30 in the face plate 20. The recess 30 is dimensioned to receive the handle in a stored position as shown in FIG. 1. The handle may be pivoted outwardly as shown in FIG. 8 to a functioning position so that the face plate 20 can be readily rotated with reference to the enclosure housing case 60.

In the operation of the assembled unit, the male plug 50 of an electric cord (probably heavy duty) is passed through the port 86 (FIG. 6) and the opening 52 (FIG. 5). Approximately 40" is pulled through. The end is now coiled in a circular fashion and laid in the recess 45. The retaining bar 54, which has been in a forward position, is now pulled over the male plug and cord to retain it. The handle 32 is pivoted out to the position shown in FIG. 8 and the face plate 20 (FIG. 1) is rotated around the axis provided by bolt 106. The cord will be wound on the spool created by the dished portions of parts 20 and 90. The dished portion 80 holds the through-bolt which is the bearing for the part 90. As described, parts 20 and 90 are secured together for mutual rotation, and the outer rim of part 90 acts as a stabilizing bearing surface in conjunction with part 60 to keep the inner spool from tipping. The rotation of the part 90 will prevent scraping of the cord against a stationary wall and thus eliminates wear on the insulation of the cord.

The cord may be completely contained in the encasement including the female plug which will enter the port 86. The carrying handle 76 allows the enclosed cord to be easily transported and stored until use is necessary. The cord may be pulled from the container without the use of the handle 32 which, when stored, is in a safe position for unwinding. The cord may be completely removed from the case if desired. However, the 40" in the recess with the male plug 50 will allow the cord to be plugged in under normal conditions and obviate the necessity of removing the cord entirely from the case.

What is claimed is:

1. A portable storage case for an electrical power cord having male and female connectors at each end which comprises:

(a) a generally dish-shaped circular molded plastic case having a radially extending side face having a first dished portion to form a first flat central wall portion spaced inwardly from the side face and an axially extending outer wall to overlie said dished portion and form a storage chamber for said power cord, the case being open at the side opposite said side face, (b) a circular face plate disposed at said opening to close said case and relatively rotatable to said case, said face plate having a second central dished portion having a second flat central wall lying parallel to said first flat central wall portion, (c) a third circular plate having a third central dished portion telescoped over said first central dished portion and affixed to said flat central wall of said second central dished portion, said third plate having a brim in the form of a cone extending from said third dished portion toward said side face of said case, the edge of said brim at the base of said cone lying in contact with said face to stabilize said circular face plate and said third circular plate, said face plate and said third circular plate forming a spool for receiving a power cord wound around the axis of said plates, and (d) axle means mounting said flat central walls of said spool on said first flat central wall of said first dished portion.

2. A portable storage case as defined in claim 1 in which the open edge of said axially extending outer wall has an offset portion radially outward of said outer wall, and said circular face plate has an axially extending flange positioned within said offset portion to rotate within said offset portion.

3. A portable storage case as defined in claim 1 in which the second dished portion is ported to allow a length at the end of a cable to pass in coiled condition from said spool to the interior of said second dished portion for supplemental storage of said end length, and a U-shaped bar having opposed legs pivotally mounted on the walls of said second dished portion to allow the bight of said U-shaped bar to move from a position adjacent the wall of said second dished portion to a position diametrically across said second dished portion to retain said coiled end length within said second dished portion.

* * * * *